US007234742B2

(12) United States Patent
VanHecker

(10) Patent No.: US 7,234,742 B2
(45) Date of Patent: Jun. 26, 2007

(54) ADJUSTABLE CLAMPING TONGS

(76) Inventor: Joel VanHecker, 3252 Garden Ave., Royal Oak, MI (US) 48073

( * ) Notice: Subject to any disclaimer, the term of this patent is extended or adjusted under 35 U.S.C. 154(b) by 0 days.

(21) Appl. No.: 10/932,444

(22) Filed: Sep. 2, 2004

(65) Prior Publication Data

US 2005/0194801 A1 Sep. 8, 2005

Related U.S. Application Data

(60) Provisional application No. 60/499,519, filed on Sep. 2, 2003.

(51) Int. Cl.
*B65G 7/12* (2006.01)

(52) U.S. Cl. ..... 294/62; 294/16

(58) Field of Classification Search ..... 294/62, 294/63.1, 103.1, 104, 16, 50.9
See application file for complete search history.

(56) References Cited

U.S. PATENT DOCUMENTS

| | | | | |
|---|---|---|---|---|
| 657,294 | A * | 9/1900 | Norcross | 294/62 |
| 705,277 | A * | 7/1902 | McDowell | 294/62 |
| 800,341 | A | 9/1905 | Tift | |
| 835,376 | A | 11/1906 | Stewart | |
| 1,091,260 | A | 3/1914 | Walker | |
| 1,153,269 | A | 9/1915 | Sturm, Sr. | |
| 1,364,128 | A | 1/1921 | Messinger | |
| 1,385,867 | A | 7/1921 | Fuller | |
| 1,581,077 | A | 4/1926 | Mosier | |
| 1,586,475 | A * | 5/1926 | Schondelmayer et al. | 294/62 |
| 3,129,029 | A | 4/1964 | Ruzza | |
| 4,055,364 | A * | 10/1977 | Breite | 294/16 |
| 5,039,150 | A | 8/1991 | Jones et al. | |

* cited by examiner

*Primary Examiner*—Dean J. Kramer
(74) *Attorney, Agent, or Firm*—Kenneth I. Kohn; Kohn & Associates, PLLC

(57) ABSTRACT

An adjustable clamping tong including a moveable pivoting clamping plate mechanism; a fixed clamping plate mechanism; and a guide mechanism for guiding the moveable pivoting clamping plate mechanism at a distal end of the guide mechanism and for fixing the fixed clamping plate mechanism at a proximal end of the guide mechanism, wherein the moveable pivoting clamping plate mechanism moves co-axially along the guide mechanism and pivots in multiple directions relative to the guide mechanism. An adjustable clamping tong including a pivoting clamping plate mechanism; a fixed clamping plate mechanism; and a spacing mechanism for spacing the pivoting clamping plate mechanism at a distal end of the spacing mechanism from the fixed clamping plate mechanism at a proximal end of the spacing mechanism, wherein the spacing mechanism includes an adjusting mechanism and the pivoting clamping plate mechanism axially pivots along the spacing mechanism.

8 Claims, 7 Drawing Sheets

ADJUSTABLE CLAMPING TONGS

CROSS REFERENCE TO RELATED APPLICATIONS

This application claims the benefit of priority under 35 U.S.C. Section 119(e) of U.S. Provisional Patent Application No. 60/499,519, filed Sep. 2, 2003, which is incorporated herein by reference in its entirety.

BACKGROUND OF THE INVENTION

1. Technical Field

The present invention relates to tools and more specifically a bricklayer's tool.

2. Background Art

Numerous brick tongs exist in the prior art that utilize complementary gripping jaws. Examples of such tongs are described in U.S. Pat. Nos. 800,341; 835,376; 1,091,260; 1,153,269; 1,364,128; 1,385,867; 1,581,077; 3,129,029; and 5,039,150. In any of these tongs, the complementary gripping jaws are brought into engagement with the faces of bricks through a connected handle. The complementary gripping jaws are separated from each through slide and guide tubes. The distance between the complementary gripping jaws depends upon the position of the slide tube relative to the guide tube. The slide tube slides and removably engages the guide tube over the outer surface of the guide tube. The length of the entire slide and guide tube assembly is adjusted through a pin inserted into any one of a multiplicity of holes set forth axially along each of the slide and guide tubes. The pin is inserted through the holes of both the slide and guide tubes, which results in fixing the length of the entire slide and guide tube.

As described above, in order to adjust for varying sizes of bricks or varying numbers of bricks, a user must disengage the pin inserted into one of the holes in the slide and guide tube assembly, subsequently adjust the length of the slide and guide tubes, and reinsert the pin through another set of holes corresponding to the desired length of the slide and guide tube assembly. This requires additional time and steps in order to adjust the brick tool. Moreover, the pin and various other parts associated with the pin can be lost or misplaced.

Accordingly, there is a need for a clamping tong that is easily adjustable wherein the complementary gripping or clamping jaws are adjustable through a simple gliding mechanism.

SUMMARY OF THE INVENTION

The present invention provides an adjustable clamping tong including a moveable pivoting clamping plate mechanism for removably engaging an object at the object's distal end; a fixed clamping plate mechanism for the engaging the object at the object's proximal end, wherein the fixed clamping plate mechanism is complementary to the moveable pivoting clamping plate mechanism; and a guide mechanism for guiding the moveable pivoting clamping plate mechanism at a distal end of the guide mechanism and for fixing the fixed clamping plate mechanism at a proximal end of the guide mechanism, wherein the moveable pivoting clamping plate mechanism moves co-axially along the guide mechanism and pivots in multiple directions relative to the guide mechanism. Furthermore, the present invention provides an adjustable clamping tong including a pivoting clamping plate mechanism for engaging a solid object at a distal end of the object; a fixed clamping plate mechanism for engaging the object at the object's proximal end, wherein the fixed clamping plate mechanism is complementary to the pivoting clamping plate mechanism; and a spacing mechanism for spacing the pivoting clamping plate mechanism at a distal end of the spacing mechanism from the fixed clamping plate mechanism at a proximal end of the spacing mechanism, wherein the spacing mechanism includes an adjusting mechanism for adjusting the distance between the pivoting clamping plate mechanism and fixed clamping plate mechanism and the pivoting clamping plate mechanism axially pivots along the spacing mechanism.

BRIEF DESCRIPTION OF THE DRAWINGS

Other advantages of the present invention will be readily appreciated as the same becomes better understood by reference of the following detailed description when considered in connection with the accompanying drawings wherein:

FIGS. 4(A)–(C) illustrate various views of another embodiment of the present invention specifically depicting the moveable pivoting clamping plate mechanism 12', wherein FIG. 4A is an embodiment of the handle 20' and FIGS. 4(B)–(C) are various views of an embodiment of the moveable pivoting clamping plate mechanism 12' including a bar mechanism 28;

FIG. 6 is a side view of the embodiment of the present invention depicted in FIG. 5, wherein

DESCRIPTION OF THE INVENTION

The present invention provides an adjustable clamping tong generally indicated as 10 in the Figures. The adjustable clamping tong 10 of the present invention utilizes complementary clamping plate mechanisms for engaging an object or objects desired to be moved.

The present invention has numerous advantages over the prior art. The present invention does not utilize slide and guide tubes having a multiplicity of holes therethrough and a guide pin inserted through the holes. Instead, the present invention utilizes complementary clamping plate mechanisms that are adjusted without the need for slide and guide tubes and the use of guide pins inserted through a multiplicity of holes. As a result, the need for a pin, wing nuts, and the like has been eliminated.

The adjustable clamping tong 10 of the present invention and its various components are made from durable materials including, but not limited to, composite materials, metals, alloys, steel, harden polymers, carbons, combinations thereof, and any other similar durable materials known to those of skill in the art. Moreover, the various components of the adjustable clamping tong 10 are permanently or removably joined, attached, and/or connected together utilizing devices including, but not limited to, screws, nails, bolts, weldable devices, welded joints, and other fixing devices known to those of skill in the art. Finally, the adjustable clamping tong 10 and its various components can be constructed utilizing various methods well known to those of skill in the art of machining, die casting, and mechanical arts.

The present invention can be utilized in numerous settings. For example, the present invention can be utilized in brickyards and at construction sites in order to move or transport objects such as stacks of bricks. Additionally, the present invention can be utilized with an automated system connected to computerized machinery to move large objects or large stacks of bricks within a brick factory or brickyard facility. Moreover, the present invention can be utilized to move any solid object of varying size including, but not limited to, bricks, wood, stones, books, stacked items, and any other items capable of being engaged between the clamping plate mechanisms of the present invention.

Figure 1:
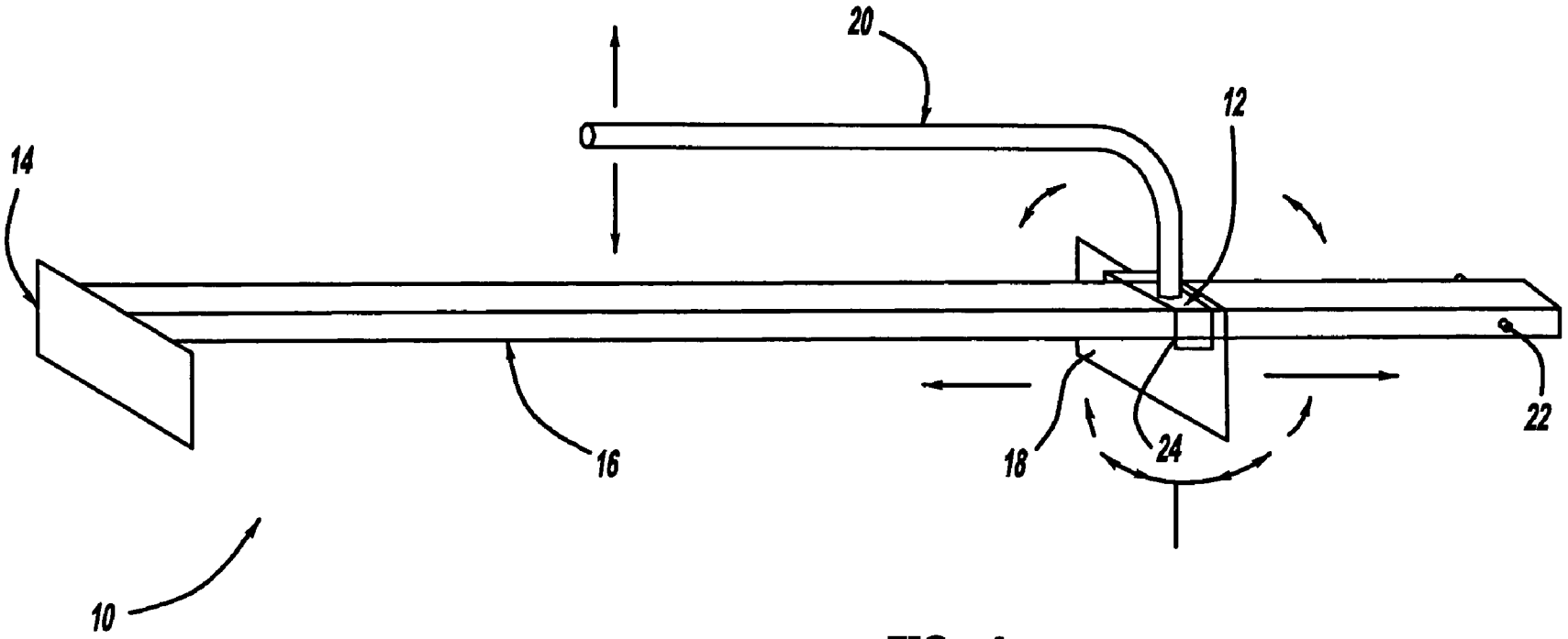
FIG. 1 is a side perspective view of an embodiment of the present invention.
Figure 2A:
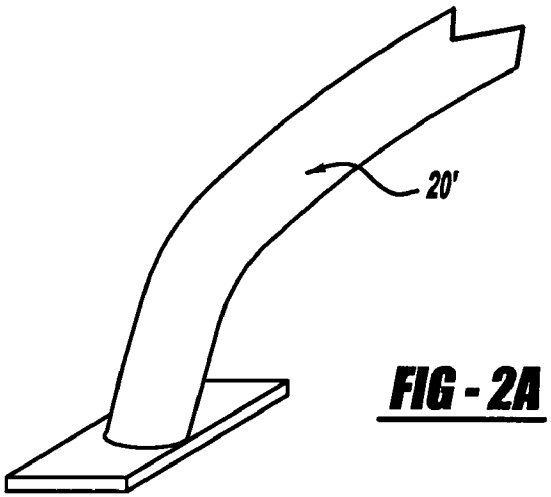
FIG. 2 illustrates various views (A)–(F) of one embodiment of the present invention, specifically depicting the moveable pivoting clamping plate mechanism.
Figure 2B:
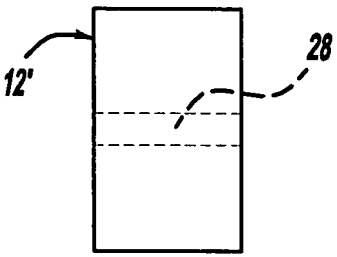
Figure 2C:
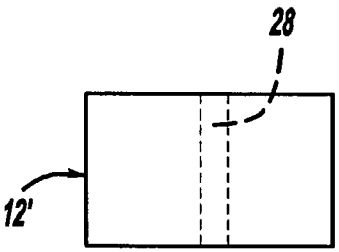
Figure 2D:
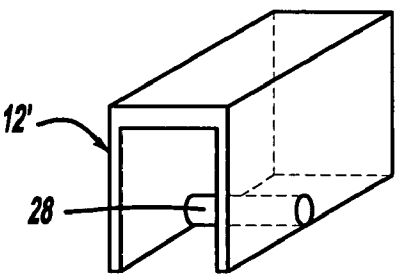
Figure 2E:
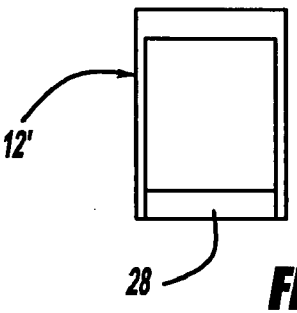
Figure 2F:
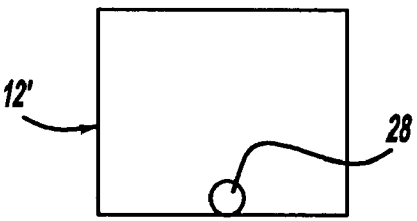

The present invention has numerous embodiments. One embodiment is illustrated in FIG. 1. In this embodiment, the present invention is directed towards an adjustable clamping tong 10 including a moveable pivoting clamping plate mechanism 12 at the adjustable clamping tong's 10 distal end. The pivoting clamping plate mechanism 12 can removably engage an object(s) at the object's distal end. Further, the adjustable clamping tong 10 includes a fixed clamping plate mechanism 14 at the proximal end of the adjustable clamping tong 10, wherein the fixed clamping plate mechanism 14 can removably engage the object(s) at the object's proximal end. The fixed clamping plate mechanism 14 is complementary to the moveable pivoting clamping plate mechanism 12. The adjustable clamping tong 10 also includes a guide mechanism 16. The guide mechanism 16 guides the moveable pivoting clamping plate mechanism 12 at the distal end of the guide mechanism 16 and also fixes the fixed clamping plate mechanism 14 at the proximal end of the guide mechanism 16.

The moveable pivoting clamping plate mechanism 12 can slide or move co-axially along the guide mechanism 16 and pivots in multiple directions relative to the guide mechanism 16. The moveable pivoting clamping plate mechanism 12 also includes an engaging mechanism 18. The engaging mechanism 18 can be any structure or device capable of removably engaging the object placed between the moveable pivoting clamping plate mechanism 12 and the fixed clamping plate mechanism 14. For example, the engaging mechanism 18 can be, but is not limited to, a plate (flat, relatively flat, and/or arch-shaped), a bar, and any other similar engaging structure known to those of skill in the art. Optionally, the engaging mechanism 18 can be a relatively flat surface or can include a multitude of protrusions or teeth in order to provide added gripping ability of the object(s). Alternatively, the engaging mechanism 18 can be any appropriate size or shape and further include material such as, but not limited to, rubber, sandpaper-like material, silicone, polymers, combinations thereof, and any other similar materials capable of providing added tackiness or increased gripping friction known to those of skill in the art.

The moveable pivoting clamping plate mechanism 12 further includes an affixed, elongated handle 20. The handle 20 extends parallel along the guide mechanism 16. Preferably, the handle 20 is slightly curved. Alternatively, the handle 20 can be bent at any desired degree near the moveable pivoting clamping plate mechanism 12. Design, size, and structure of the handle 20 depend upon desired requirements and engineering. Further, the moveable pivoting clamping plate mechanism 12 includes an aperture 24. The aperture 24 is larger than the outer circumference of the guide mechanism 16. The size of the aperture 24 of the moveable pivoting clamping plate mechanism 12 is large enough to allow for the moveable pivoting clamping plate mechanism 12 to slide or move co-axially along the guide mechanism, yet small enough to allow the moveable pivoting clamping plate mechanism 12 to pivot towards or away from the object(s) on the guide mechanism 16.

As for the fixed clamping plate mechanism 14, it is immoveable and permanently fixed to the guide mechanism 16. The fixed clamping plate mechanism 14 can also include an engaging mechanism 18. The engaging mechanism 18 can be any structure or device capable of removably engaging the object(s) placed between the moveable pivoting clamping plate mechanism 12 and the fixed clamping plate mechanism 14. For example, the engaging mechanism 18 can be, but is not limited to, a plate, a bar, and any other similar engaging structure known to those of skill in the art. Optionally, the engaging mechanism 18 can be a relatively flat surface or can include a multitude of protrusions or teeth in order to provide added gripping ability of the object. Alternatively, the engaging mechanism 18 can be any appropriate size and further include material such as, but not limited to, rubber, sandpaper-like material, silicone, polymers, combinations thereof, and any other similar materials capable of providing added tackiness or increased gripping friction known to those of skill in the art. Preferably, the size of the engaging mechanisms 18 of the moveable pivoting clamping plate mechanism 12 and the fixed clamping plate mechanism 14 are the same size. Further, the engaging mechanism 18 can be similarly constructed or be composed of the same material. However, each engaging mechanism 18 can vary in size, structure, material, and design from each other depending upon desired requirements.

The guide mechanism 16 of the adjustable clamping tong 10 of the present invention is any structure capable of supporting the moveable pivoting clamping plate mechanism 12 and the fixed clamping plate mechanism 14 and any object(s) placed therebetween. The guide mechanism 16 can be any structure such as, but not limited to, rod, a bar, a tube, a U-shaped channel, and any other similar structure known to those of skill in the art. Further, the guide mechanism 16 can be any appropriate length and size as desired. Moreover, the outer, cross-sectional shape of the guide mechanism 16 can be, but is not limited to, a circle, a square, rectangle, triangle, polygonal, and any other similar shapes known to those of skill in the art.

The guide mechanism 16 further includes a stop mechanism 22 at the distal end of the guide mechanism 16 for preventing the moveable pivoting clamping plate mechanism 12 from disengaging from or sliding off of the guide mechanism 16. The stop mechanism 22 can be any structure that obstructs the movement of moveable pivoting clamping plate mechanism 16. The structure 22 can radially protrude or extend from the guide mechanism 16. Alternatively, the structure 22 can be a structure that is larger than the aperture of the moveable pivoting clamping plate mechanism 12. These structures include, but are not limited to, a weld, radial extension of the guide mechanism 16, a pin, a rod, and any other similar structure known to those of skill in the art.

In the above embodiment of the present invention, the moveable pivoting clamping plate mechanism 12 pivots in multiple directions on and relative to the guide mechanism 16. The moveable pivoting clamping plate mechanism 12 pivots about the guide mechanism 16 through the aperture 24 that is larger than the outer circumference of the guide mechanism 16. The size of the aperture 24 of the moveable pivoting clamping plate mechanism 12 is large enough to allow for the moveable pivoting clamping plate mechanism 12 to pivot towards the object(s) when vertical, upward pressure is applied to the handle 20 attached to the moveable pivoting clamping plate mechanism 12 and extending along the guide mechanism 16. In use, a user can adjust the spacing between the moveable pivoting clamping plate mechanism 12 and the fixed clamping plate mechanism 14 by sliding or moving the moveable clamping plate mechanism 12 co-axially along the guide mechanism 16 and towards the distal end of the object(s). Once the desired spacing is achieved, the user applies upward force to the handle 20 (i.e., lifts up or picks up the handle 20), which results in the moveable pivoting clamping plate mechanism 12 pivoting against the guide mechanism 16 and the engaging mechanism 18 engages a face of the distal end of the object(s). Since the opposite, proximal end of the object(s) is also engaged by the fixed clamping plate mechanism 14, the object(s) is now securely engaged between both the fixed clamping plate mechanism 14 and the moveable pivoting clamping plate mechanism 12. As a result, the object(s) can now be lifted utilizing the adjustable clamping tong 10 of the present invention.

Figure 3A:
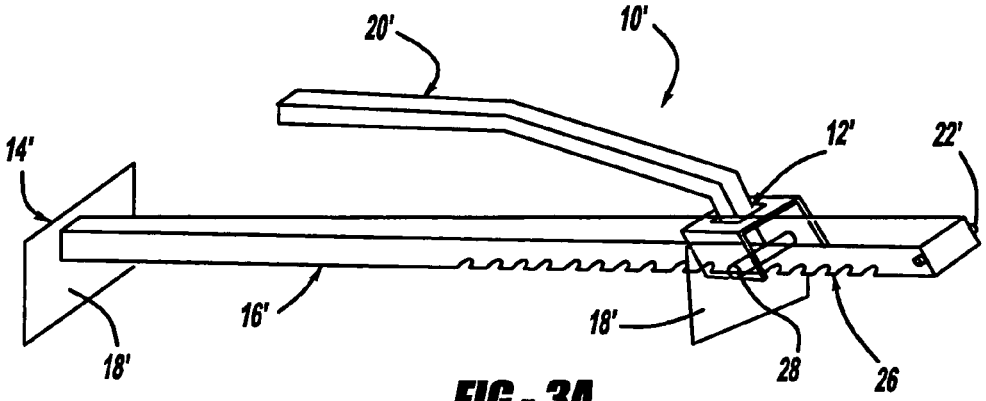
FIG. 3A is a side perspective view of an embodiment of the present invention and FIG. 3B is a three-dimensional view of another embodiment of the present invention wherein the guide mechanism 16 includes numerous notches for engaging the moveable pivoting clamping plate mechanism 12 and adjustment thereof.
Figure 3B:
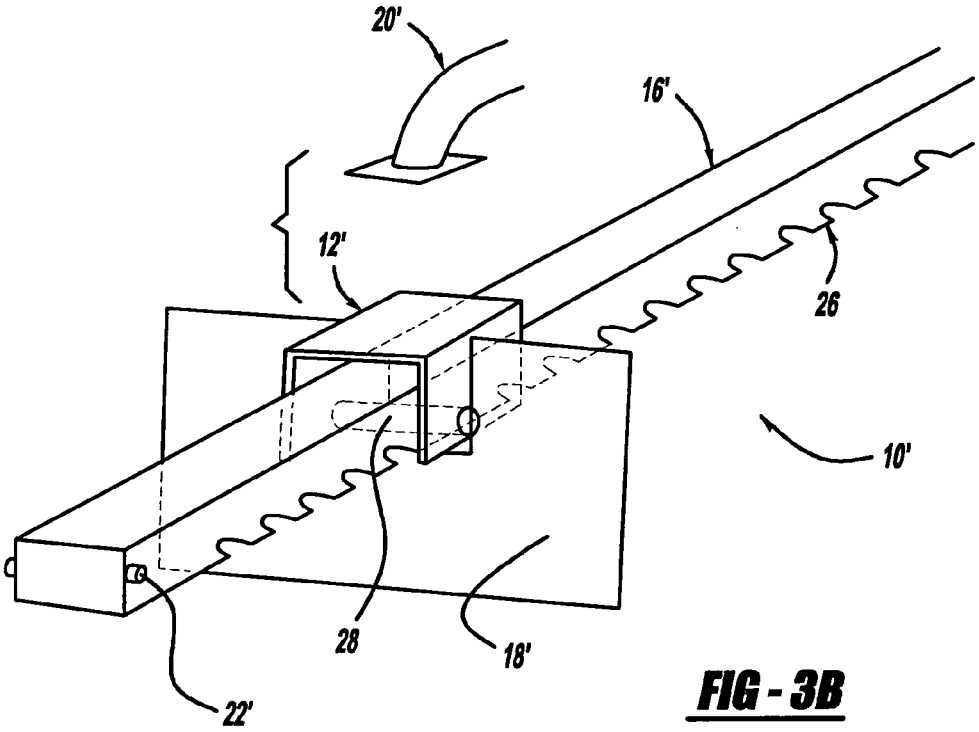
Figure 4A:
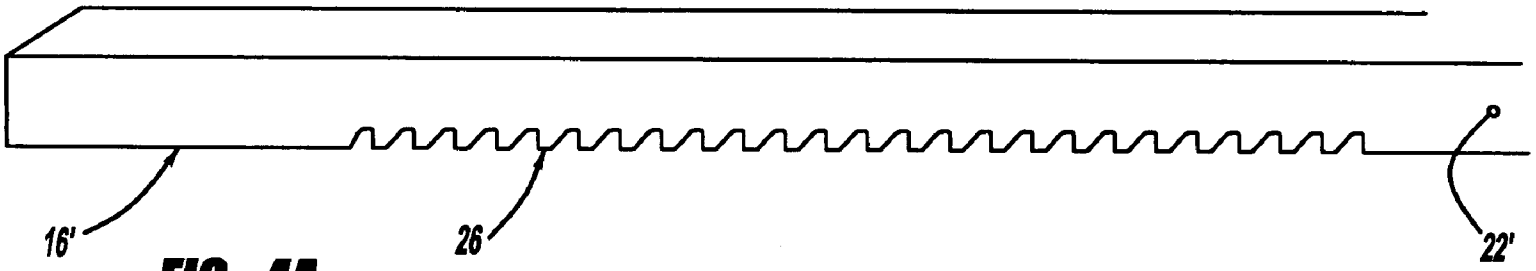
Figure 4B:
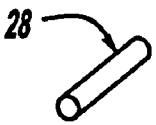
Figure 4C:
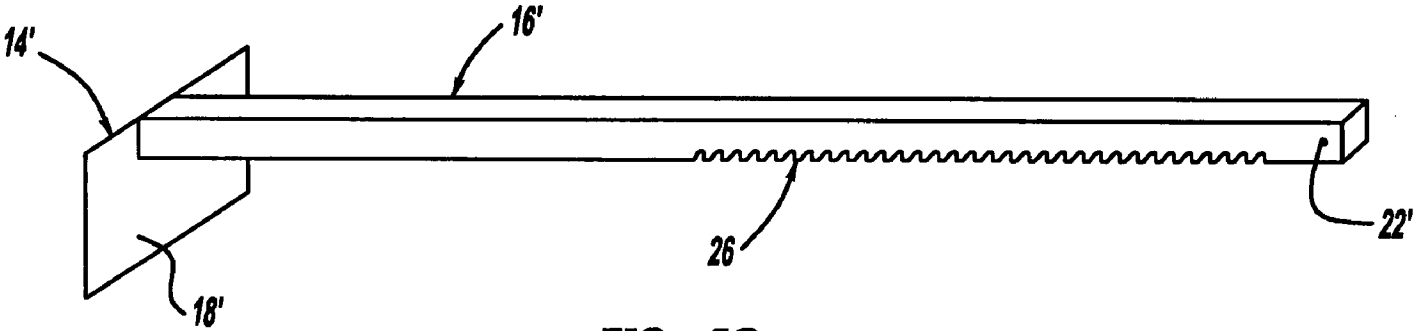

In an alternative embodiment of the present invention, the structures are similar to those set forth above except for the following (See, FIGS. 2, 3, and 4). First, the guide mechanism 16' includes a preventing mechanism 26. The preventing mechanism 26 is a structure including, but not limited to, at least one machined notch or teeth co-axially situated along the guide mechanism 16' or any other similar structures known to those of skill in the art. The preventing mechanism 26 prevents the moveable pivoting clamping plate mechanism 12' from co-axially moving away from the complementary fixed clamping plate mechanism 14' and for allowing the moveable pivoting clamping plate mechanism 12' to co-axially move towards the complementary fixed clamping plate mechanism 14'. In order for the preventing mechanism 26 to operate, it removably engages a bar mechanism 28 of the moveable pivoting clamping plate mechanism 12'. The bar mechanism 28 is any structure including, but not limited to, a rod, pin, bar, and any other similar structure capable of removably engaging the preventing mechanism 26. The bar mechanism 28 is fixedly attached to the moveable pivoting clamping plate mechanism 12'. Preferably, the bar mechanism 28 operatively engages with the guide mechanism 16' through a series of notches 26. The notches 26 are axially located along the length of the guide tube. The notches 26 are machined in a manner so that the moveable pivoting clamping plate mechanism 12' can be moved lengthwise along the guide mechanism 16'. However, when the bar mechanism 28 is engaged with the notches 26, the moveable pivoting clamping plate mechanism 12' can move co-axially along the guide mechanism 16' towards the complementary fixed clamping plate mechanism 14. Movement towards the fixed clamping plate mechanism 14 is prevented by the object(s) itself. However, co-axial movement along the length of the guide mechanism 16' is prevented by the notches 26 of the guide mechanism 16', while the bar mechanism is removably engaged with the notches 26 of the guide mechanism 16'.

In another embodiment of the present invention (See, FIGS. 5, 6, and 7), the adjustable clamping tong 10" includes a pivoting clamping plate mechanism 30 for engaging an object(s) at a distal end of the object(s). Further, the adjustable clamping tong 10" includes a fixed clamping plate mechanism 14" for engaging the object(s) at the object's proximal end, wherein the fixed clamping plate mechanism 14" is complementary to the pivoting clamping plate mechanism 30. Finally, the adjustable clamping tong 10" includes a spacing mechanism 32 for spacing the pivoting clamping plate mechanism 30 at a distal end of the spacing mechanism 32 from the fixed clamping plate mechanism 14" at a proximal end of the spacing mechanism 32. The spacing mechanism 32 further includes an adjusting mechanism 34 for adjusting the distance between the pivoting clamping plate mechanism 30 and the fixed clamping plate mechanism 14".

The pivoting clamping plate mechanism 30 is attached or affixed to the spacing mechanism 32 at the distal end of the spacing mechanism 32. The pivoting clamping plate mechanism 30 does not co-axially move along the spacing mechanism 32; instead, the pivoting clamping plate mechanism 30 pivots in a direction co-axially along the spacing mechanism 32. The pivoting clamping plate mechanism 30 is attached to the spacing mechanism 32 via a pivoting device 36 including, but not limited to, a hinge, locking pin(s), and the like. The pivoting clamping plate mechanism 30 also includes an engaging mechanism 18". The engaging mechanism 18" can be any structure or device capable of removably engaging the object(s) placed between the pivoting clamping plate mechanism 30 and the fixed clamping plate mechanism 14". For example, the engaging mechanism 18" can be, but is not limited to, a plate (flat, relatively flat, and/or arch-shaped), a bar, and any other similar engaging structure known to those of skill in the art. Optionally, the engaging mechanism 18" can be a relatively flat surface or can include a multitude of protrusions or teeth in order to provide added gripping ability of the object. Alternatively, the engaging mechanism 18" can be any appropriate size or shape and further include material such as, but not limited to, rubber, sandpaper-like material, silicone, polymers, combinations thereof, and any other similar materials capable of providing added tackiness or increased gripping friction.

The pivoting clamping plate mechanism 30 further includes an affixed, elongated handle 20". The handle 20" extends parallel along the spacing mechanism 32. Preferably, the handle 20" is slightly curved. Alternatively, the handle 20" can be bent at any appropriate angle near the pivoting clamping plate mechanism 30. Design, size, and structure of the handle 20" depends upon desired requirements and engineering. Further, the handle 20" can be permanently affixed, utilizing various devices well known to those of skill in the art, to the pivoting clamping plate mechanism 30. Preferably, the handle 20" and the pivoting clamping plate mechanism 30 are affixed in a manner so that both the handle 20" and the pivoting clamping plate mechanism 30 act as a unitary piece. In use, the pivoting clamping plate mechanism 30 pivots towards the object(s) when vertical, upward force (i.e., force perpendicular to length or axis of the spacing mechanism 32) is applied to the handle 20" attached to the pivoting clamping plate mechanism 30 and extending along the length of the spacing mechanism 32. Therefore, when a user applies the upward force to the handle 20" (i.e., lifts up or picks up the handle 20') the pivoting clamping plate mechanism 30 pivots through the pivoting device 36 and forces the engaging mechanism 18" to removably engage a face of the distal end of the object(s). Since the opposite, proximal end of the object(s) is also engaged by the fixed clamping plate mechanism 14", the object(s) is now securely engaged between both the fixed clamping plate mechanism 14" and the pivoting clamping plate mechanism 30. As a result, the object(s) can now be lifted utilizing the adjustable clamping tong 10" of the present invention.

As for the fixed clamping plate mechanism 14", it is immoveable and permanently fixed to the spacing mechanism 32. The fixed clamping plate mechanism 14" can also include an engaging mechanism 18". The engaging mechanism 18" can be any structure or device capable of removably engaging the object placed between the pivoting clamping plate mechanism 30 and the fixed clamping plate mechanism 14". For example, the engaging mechanism 18" can be, but is not limited to, a plate, a bar, and any other similar engaging structure known to those of skill in the art. Optionally, the engaging mechanism 18" can be a relatively flat surface or can include a multitude of protrusions or teeth in order to provide added gripping ability of the object(s). Alternatively, the engaging mechanism 18" can be any appropriate size and further include material such as, but not limited to, rubber, sandpaper-like material, silicone, polymers, combinations thereof, and any other similar materials capable of providing added tackiness or increased gripping friction known to those of skill in the art. Preferably, the size of the engaging mechanisms 18" of the pivoting clamping plate mechanism 30 and the fixed clamping plate mechanism 14" are the same size. Further, the engaging mechanism 18" can be similarly constructed or be composed of the same material; However, each engaging mechanism 18" can vary in size, structure, material, and design from each other depending upon desired requirements. The spacing mechanism 32 of the adjustable clamping tong 10 of the present invention is any structure capable of supporting the pivoting clamping plate mechanism 30 and the fixed clamping plate mechanism 14" and any object(s) placed therebetween (See, FIGS. 5, 6, and 7). Preferably, the spacing mechanism 32 includes two structures 38, 40 operatively connected through an adjusting mechanism 34. The structures 38, 40 each have a proximal and a distal end. The structures can be, but are not limited to, a rod, a bar, a tube, a U-shaped channel, and any other similar structures known to those of skill in the art. Further, the size, length, and shape of the spacing mechanism 32 vary according to desired requirements or designs. Moreover, the outer, cross-sectional shape of the spacing mechanism 32 can be, but is not limited to, a circle, a square, rectangle, triangle, polygonal, and any other similar shapes known to those of skill in the art.

The two structures 38, 40 are connected at the distal end of a first structure 38 and at the proximal end of a second structure 40. Then, the proximal end of the first structure 38 is attached to the fixed clamping plate mechanism 14" and the distal end of the second structure 40 is attached to the pivoting clamping mechanism 30. The two structures 38, 40 engage with each other and can interlock with each other. In other words, the first structure 38 can fit within a chamber or channel of the second structure 40, or vice versa. This type of interaction and engagement allows for the shortening of the overall length of the spacing mechanism 32.

It is preferred that the second structure 40 includes a stop mechanism 22" at the distal end of the second structure 40 for preventing the first structure 38 from disengaging from the second structure 40. The stop mechanism 22" can be any structure that obstructs the movement of the first structure 38 through the adjusting mechanism 34. Further, the second structure 40 includes a locking mechanism 42, which is a series of at least one, machined notch co-axially located along the length of the spacing mechanism 32. The locking mechanism 42 engages with a bar mechanism 44 as described below.

Figure 5:
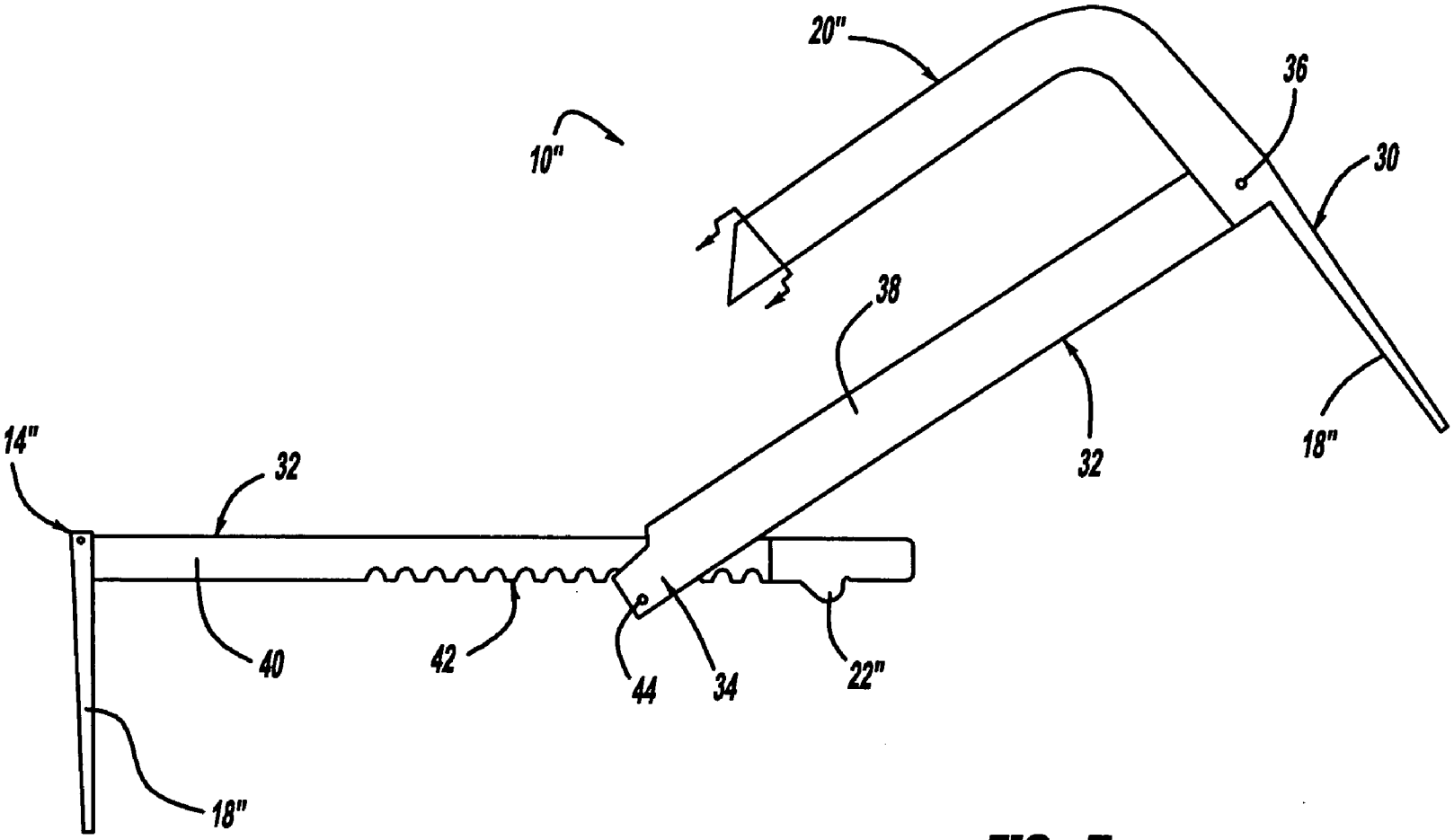
FIG. 5 is a side view of another embodiment of the present invention, wherein an adjusting mechanism 34 is centrally situated.
Figure 6A:
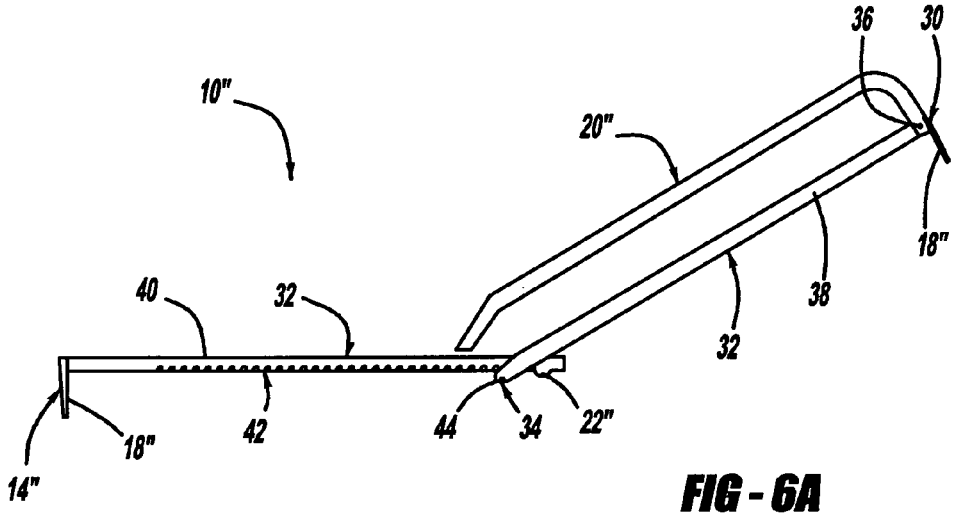
FIG. 6A illustrates the present invention in an unlocked and adjusting position.
Figure 6B:
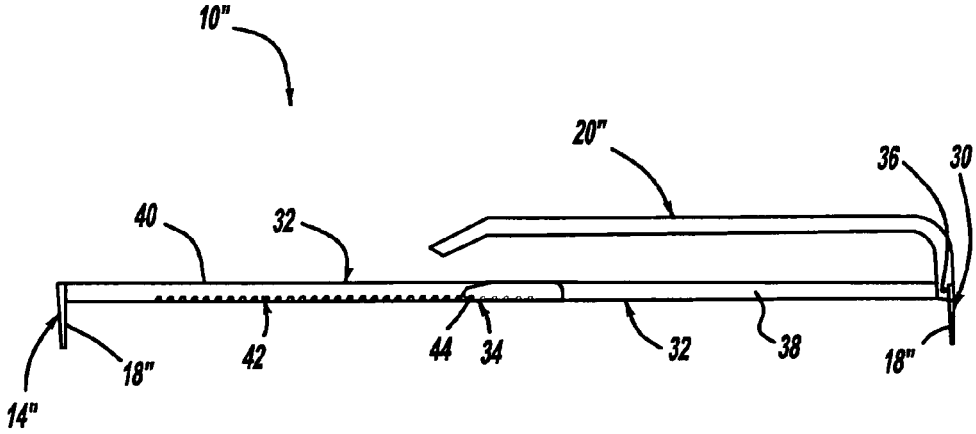
FIG. 6B illustrates the present invention in a locked position.
Figure 7:
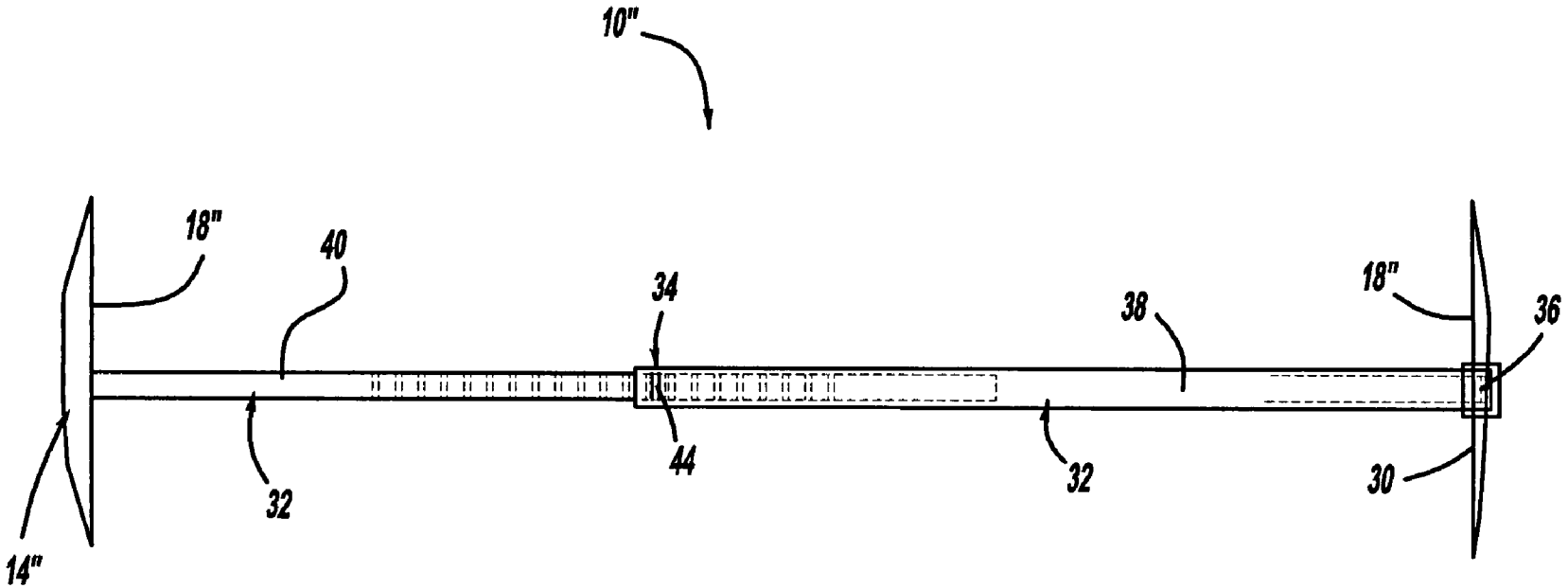
FIG. 7 is a top view of the embodiment of the present invention depicted in FIG. 5.

The adjusting mechanism 34 is any device capable of locking the engagement of the structures 38, 40 of the spacing mechanism 32 (See, FIGS. 6B and 7), while also capable of releasing the engagement thereof (See, FIGS. 5 and 6A). When the adjusting mechanism 34 is in a locked position (See, FIGS. 6B and 7), the spacing mechanism 32 is in a fixed length. When the adjusting mechanism 34 is in an unlocked position (See, FIGS. 5 and 6A), the length of the spacing mechanism 32 (through the shortening or lengthening of the structures 38, 40) can be adjusted. The adjusting mechanism 34 includes a bar mechanism 44 for operatively engaging the locking mechanism 42 for locking the first structure 38 from moving and ultimately preventing the pivoting clamping plate mechanism 30 from co-axially moving away from the fixed clamping plate mechanism 14". The bar mechanism 44 can be any structure including, but not limited to, a bar, pin, stationary pin, adjustable pin, and any similar structure known to those of skill in the art.

Throughout this application, various publications, including United States patents, are referenced by author and year and patents by number. Full citations for the publications are listed below. The disclosures of these publications and patents in their entireties are hereby incorporated by reference into this application in order to more fully describe the state of the art to which this invention pertains.

The invention has been described in an illustrative manner, and it is to be understood that the terminology that has been used is intended to be in the nature of words of description rather than of limitation.

Obviously, many modifications and variations of the present invention are possible in light of the above teachings. It is, therefore, to be understood that within the scope of the described invention, the invention may be practiced otherwise than as specifically described.

What is claimed is:

1. An adjustable clamping tong comprising:

(a) moveable pivoting clamping plate means for removably engaging an object at the object's distal end;

(b) fixed clamping plate means for the engaging the object at the object's proximal end, wherein said fixed clamping plate means is complementary to said moveable pivoting clamping plate means;

(c) guide means for guiding said moveable pivoting clamping plate means at a distal end of said guide means and for fixing said fixed clamping plate means at a proximal end of said guide means, wherein said moveable pivoting clamping plate means moves co-axially along said guide means and pivots in multiple directions relative to said guide means, said moveable pivoting clamping plate means including an aperture through which said guide means fit;

(d) stop means on the distal end of said guide means for preventing said moveable pivoting clamping plate means from disengaging said guide means; and (e) handle means fixedly attached to said moveable pivoting clamping plate means for pivoting said moveable pivoting clamping plate means, thereby clampingly engaging the object between said moveable pivoting clamping plate means and said fixed clamping plate means when said handle means is lifted.

2. The adjustable clamping tong according to claim 1, wherein said guide means is a structure selected from the group consisting of a rod, a bar, a tube, and a U-shaped channel.

3. The adjustable clamping tong according to claim 1, wherein said guide means includes preventing means for preventing said moveable pivoting clamping plate means from moving axially away from said complementary fixed clamping plate means and for allowing said moveable pivoting clamping plate means to axially move towards said complementary fixed clamping plate means.

4. The adjustable clamping tong according to claim 3, wherein said preventing means is defined as at least one machined notch axially situated along said guide means.

5. The adjustable clamping tong according to claim 4, wherein said moveable pivoting clamping plate means includes bar means for engaging said preventing means.

6. The adjustable clamping tong according to claim 5, wherein said bar means is a pin.

7. The adjustable clamping tong according to claim 1, wherein the adjustable clamping tong is made of materials selected from the group consisting of metal, steel, alloys, hardened plastics, and combinations thereof.

8. An adjustable clamping tong comprising:

(a) pivoting clamping plate means for engaging a solid object at a distal end of the object;

(b) fixed clamping plate means for engaging the object at the object's proximal end, wherein said fixed clamping plate means is complementary to said pivoting clamping plate means;

(c) spacing means for spacing said pivoting clamping plate means at a distal end of said spacing means from said fixed clamping plate means at a proximal end of said spacing means, wherein said spacing means includes adjusting means for adjusting a distance between said pivoting clamping plate means and fixed clamping plate means and said pivoting clamping plate means axially pivots along said spacing means and said spacing means includes two structures selected from the group consisting of a rod, a bar, a tube, and a U-shaped channel, wherein said structures operatively engage with each other through said adjusting means;

(d) stop means on the distal end of said spacing means for preventing said pivoting clamping plate means from disengaging said spacing means; and (e) handle means fixedly attached to said pivoting clamping plate means for pivoting said pivoting clamping plate means, thereby clampingly engaging the object between said pivoting clamping plate means and said fixed clamping plate means when said handle means is lifted.

* * * * *